US006111234A

United States Patent [19]

Batliwalla et al.

[11] Patent Number: 6,111,234

[45] Date of Patent: Aug. 29, 2000

[54] ELECTRICAL DEVICE

[76] Inventors: Neville S. Batliwalla, 221 Beach Park Blvd., Foster City, Calif. 94404; James C. Thompson, 637 Linden Ave., Los Altos, Calif. 94022

[21] Appl. No.: 08/211,829

[22] PCT Filed: May 7, 1991

[86] PCT No.: PCT/US91/03123

§ 371 Date: Nov. 6, 1992

§ 102(e) Date: Nov. 6, 1992

[87] PCT Pub. No.: WO91/17642

PCT Pub. Date: Nov. 14, 1991

[51] Int. Cl.[7] ..... H05B 3/34; H01C 7/00

[52] U.S. Cl. ..... 219/549; 219/544; 338/214

[58] Field of Search ..... 219/552, 504, 219/549, 511, 528, 544, 553, 541; 338/20, 214, 22 R, 212

[56] References Cited

U.S. PATENT DOCUMENTS

| | | | |
|---|---|---|---|
| 3,576,388 | 4/1971 | Bruns | 174/116 |
| 3,727,029 | 4/1973 | Chrow | 219/301 |
| 3,793,716 | 2/1974 | Smith-Johannsen | 29/611 |
| 3,858,144 | 12/1974 | Bedard et al. | 338/22 R |
| 3,861,029 | 1/1975 | Smith-Johannsen et al. | 29/611 |
| 4,017,715 | 4/1977 | Whitney et al. | 219/553 |
| 4,072,848 | 2/1978 | Johnson et al. | 219/528 |
| 4,151,366 | 4/1979 | Betts | 219/544 |
| 4,188,276 | 2/1980 | Lyons et al. | 204/159.17 |
| 4,200,973 | 5/1980 | Farkas | 29/611 |
| 4,237,441 | 12/1980 | van Konynenburg et al. | 338/22 R |
| 4,242,573 | 12/1980 | Batliwalla | 219/528 |
| 4,246,468 | 1/1981 | Horsma | 219/553 |
| 4,334,148 | 6/1982 | Kampe | 219/553 |
| 4,334,351 | 6/1982 | Sopory | 29/611 |
| 4,388,607 | 6/1983 | Toy et al. | 338/22 SD |
| 4,398,084 | 8/1983 | Walty | 219/528 |
| 4,400,614 | 8/1983 | Sopory | 219/528 |
| 4,425,497 | 1/1984 | Leary et al. | 219/544 |
| 4,426,339 | 1/1984 | Kamath et al. | 264/22 |
| 4,435,639 | 3/1984 | Gurevich | 219/544 |
| 4,459,473 | 7/1984 | Kamath | 219/553 |
| 4,470,898 | 9/1984 | Penneck et al. | 252/511 |
| 4,514,620 | 4/1985 | Cheng et al. | 219/553 |
| 4,534,889 | 8/1985 | von Konynenburg et al. | 252/511 |
| 4,547,626 | 10/1985 | Pedersen et al. | 174/107 |
| 4,547,659 | 10/1985 | Leary | 219/554 |
| 4,560,498 | 12/1985 | Horsma et al. | 252/511 |
| 4,574,188 | 3/1986 | Midgley et al. | 219/549 |
| 4,582,983 | 4/1986 | Midgley et al. | 219/539 |
| 4,591,700 | 5/1986 | Sopory | 219/505 |
| 4,658,121 | 4/1987 | Horsma et al. | 219/553 |
| 4,659,913 | 4/1987 | Midgley et al. | 219/549 |
| 4,661,687 | 4/1987 | Afkhampour et al. | 219/301 |
| 4,673,801 | 6/1987 | Leary | 219/544 |
| 4,677,418 | 6/1987 | Shulver | 338/214 |
| 4,764,664 | 8/1988 | Kamath et al. | 219/548 |
| 4,774,024 | 9/1988 | Deep et al. | 252/511 |
| 4,775,778 | 10/1988 | van Konynenburg et al. | 219/549 |
| 4,935,156 | 6/1990 | van Konynenburg et al. | 219/553 |
| 4,980,541 | 12/1990 | Shafe et al. | 219/548 |
| 5,111,032 | 5/1992 | Batliwalla et al. | 219/549 |

FOREIGN PATENT DOCUMENTS

| | | |
|---|---|---|
| 0038713 | 10/1981 | European Pat. Off. . |
| 0038718 | 10/1981 | European Pat. Off. . |
| 0197759 | 10/1986 | European Pat. Off. . |
| 0231068 | 8/1987 | European Pat. Off. . |
| 0312485 | 4/1989 | European Pat. Off. . |
| 2504554 | 1/1975 | Germany . |
| WO91/03822 | 3/1991 | WIPO . |

OTHER PUBLICATIONS

Reference Standard for Electrical Wires, Cables, and Flexible Cords—UL 1581, §1080, VW–1 (Vertical–Wire) Flame Test (Aug. 8, 1985).

*Primary Examiner*—Sang Paik

*Attorney, Agent, or Firm*—Marguerite E. Gerstner

[57] ABSTRACT

An elongate heater (1) in which a resistive heating element core is surrounded by a first insulating jacket (9) and a second insulating jacket (11). In a preferred embodiment the resistive heating element core comprises a conductive polymer composition (3) and the heater passes the VW-1 flame test. The second insulating jacket (11) may be made from the same material as the first insulating jacket (9). For some applications it is preferred that the second insulating jacket be a thin film, e.g. polyester film.

19 Claims, 1 Drawing Sheet

ELECTRICAL DEVICE

CROSS-REFERENCE TO RELATED APPLICATIONS

This application is a continuation-in-part application of co-pending, commonly assigned application Ser. No. 07/519,701, filed May 7, 1990, and of International Application No. PCT/US91/03123, filed May 7, 1991, the disclosures of which are incorporated herein by reference.

BACKGROUND OF THE INVENTION

1. Field of the Invention

This invention relates to electrical devices comprising resistive heating elements, in particular self-regulating strip heaters which comprise resistive heating elements composed of a conductive polymer composition which exhibits PTC behavior.

2. Introduction to the Invention

For many applications, it is desirable to heat a substrate, e.g. a pipe or a tank, by means of an elongate heater comprising a resistive heating element. Often it is necessary to provide an electrically insulating jacket around the resistive heating element in order to prevent electrical shorting between the resistive element and an electrically conductive substrate. While such insulating jackets provide electrical insulation and environmental protection, they may not have adequate abrasion resistance. As a result, braids are sometimes provided over the insulating jacket for toughness and abrasion resistance. When the braid is metallic, it can also act as a grounding braid.

SUMMARY OF THE INVENTION

In recent years, there has been an increasing emphasis on the desirability of reducing the flammability of elongate heaters having polymeric insulating jackets, particularly self-regulating conductive polymer heaters. A standard way of assessing the flammability of an elongate heater is the Underwriter's Laboratory VW-1 flame test, published in Reference Standard for Electrical Wires, Cables, and Flexible Cords, UL 1581, No. 1080, Aug. 15, 1983. Heaters which contain polyolefin jackets, and/or resistive elements comprising conductive polymers based on polyolefins are less likely to pass the VW-1 test than heaters which contain fluoropolymer jackets and/or resistive elements comprising fluoropolymers. A heater which comprises a metallic grounding braid is generally more flammable than the corresponding non-braided heater. The flammability of a heater can be reduced by using (in the insulating jacket and/or in the resistive element if it is composed of a conductive polymer) a polymer which has low flammability, for example by using a fluorinated polymer instead of a polyolefin. Flammability can also be reduced by incorporating flame retardants, e.g. antimony trioxide and/or halogen-containing additives, into the polymer. However, these expedients suffer from disadvantages such as added cost and weight, processing difficulties, and inferior physical properties such as flexibility. In addition, there are circumstances where the use of halogen-containing materials is forbidden or discouraged.

We have discovered that the flammability of an elongate heater can be reduced by providing it with an additional insulating jacket, or by replacing a single insulating jacket (including one of two insulating jackets) by two or more jackets. In this way, a heater which fails the VW-1 test can be converted into one which passes the VW-1 test. When a further insulating jacket is added to an existing heater, on top of, or underneath, the conventional jacket(s), the reduction in flammability is not determined by (though it may be influenced by) the flammability of the material of the further insulating jacket. Even jackets which are made of materials which would normally be regarded as flammable can be effective. For example, we have obtained remarkable reductions in flammability by wrapping a thin film of polyethylene terephthalate around the conventional insulating jackets of known heaters. Similarly, when a single insulating jacket is replaced by a combination of two insulating jackets, the combination may be one which, for properties other than flammability, is substantially equivalent to the single jacket. For example, we have found that by replacing a single polyolefin-based insulating jacket by two insulating jackets made of the same material and having the same total thickness, a reduction in flammability is achieved.

Elongate heaters having two (or even more) insulating jackets have been used, or proposed for use, in the past, but only for purposes which do not, so far as we know, have any connection with flammability. Such known heaters do not, of course, per se form part of our invention. However, our invention does include heaters which make use of such known combinations of insulating jackets but which are otherwise different from the known heaters, for example through the use of heating cores which are different from those around which such combinations have previously been placed. In particular, the invention includes novel heaters containing known combinations of insulating jackets which, in the prior art, were selected for reasons related to the heater core (or to one or more other components of the heater) when those reasons do not apply to the novel heaters.

In a first aspect, this invention provides an elongate heater which passes the VW-1 flame test and which comprises (1) a core which comprises a resistive heating element;

(2) a first insulating jacket which (a) surrounds the core, and (b) is composed of a first insulating material comprising an organic polymer, and (3) a second insulating jacket which surrounds and contacts the first insulating jacket;

the components of the heater being such that (a) a heater which is substantially identical, except that it does not contain the second insulating jacket, fails the VW-1 flame test, and (b) a heater which is substantially identical, except that it does not contain the first insulating jacket, fails the VW-1 flame test.

In a second aspect, this invention provides a heater assembly for heating a substrate, said assembly comprising (1) a heater which comprises (a) a core which comprises a resistive heating element;

(b) a first insulating jacket which surrounds the core, and which is composed of a first insulating material comprising an organic polymer, and (c) a second insulating jacket which has been formed by wrapping a preformed tape of a second insulating material or a metallized polymer tape around the first insulating jacket so that the edges of the tape overlap, the tape preferably comprising a polyester and having a thickness of less than 0.005 inch.; and (2) an insulation layer which comprises PVC, preferably PVC foam, said heater being positioned in contact with the substrate and being surrounded by the insulation layer.

BRIEF DESCRIPTION OF THE DRAWING

The invention is illustrated by the drawing in which.

DETAILED DESCRIPTION OF THE INVENTION

Figure 1:
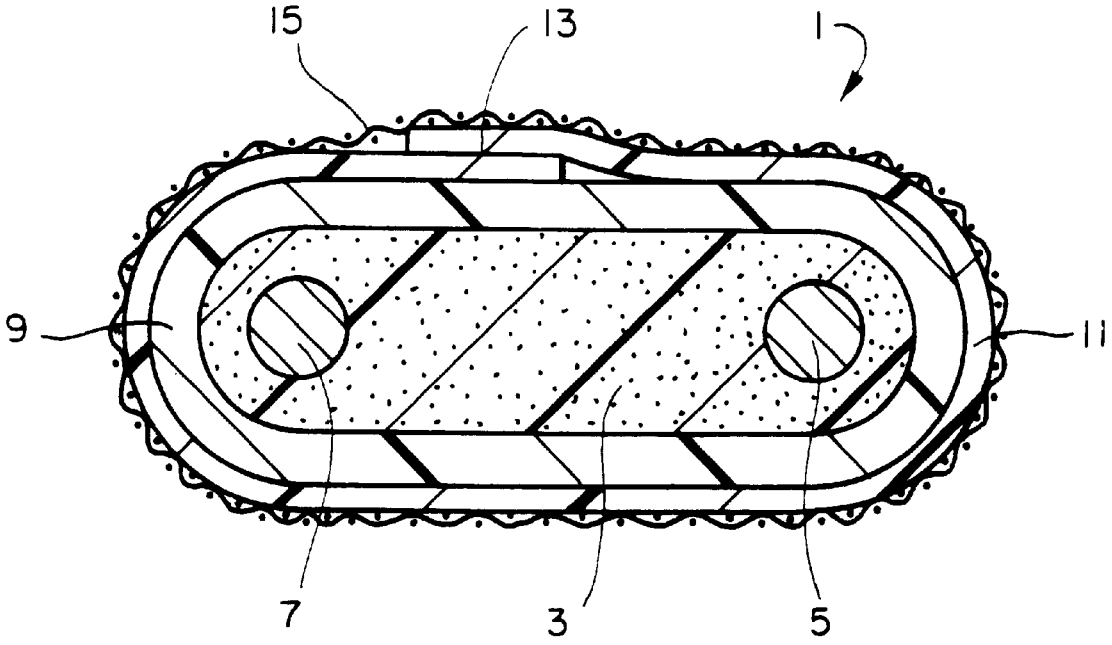
FIGS. 1 and 2 show cross-sectional views of elongate heaters of the invention.

The elongate heaters of the invention preferably pass the Underwriters' Laboratory VW-1 vertical-wire flame test, as hereinafter described ("Flame Test") and as published in Reference Standard for Electrical Wires, Cables, and Flexible Cords, UL 1581, No. 1080, Aug. 15, 1983, the disclosure of which is incorporated herein by reference.

The elongate heaters of the invention comprise a core which comprises a resistive heating element and which is surrounded by a first insulating jacket and a second insulating jacket. The first insulating jacket is the inner jacket and the second insulating jacket is the outer jacket. It is to be understood that the invention includes heaters in which the materials, thicknesses, etc. given for the first jacket are used for the second jacket, and vice versa.

The heater core preferably also comprises two elongate electrodes having the resistive heating element(s) connected in parallel between them. However, a series or mixed series/parallel heater can also be used. The resistive heating element may be in the form of a continuous strip, or in the form of a plurality of spaced-apart individual heating elements. The latter arrangement is preferred when the heating element is prepared from stiff, brittle, or rigid material. When the core comprises two elongate spaced-apart electrodes, the electrodes are usually in the form of solid or stranded metal wires, e.g. tin- or nickel-coated copper wires, although other electrically conductive materials, e.g. conductive paints, metal foils or meshes, may be used. When there are a plurality of heating elements, each of them is electrically and physically connected to the electrodes. The electrodes can be wholly or partially embedded in the material of the resistive element or attached to the surface of the resistive element. When the heating element is in the form of a continuous strip, the electrodes can be embedded therein, or, as disclosed in U.S. Pat. No. 4,459,473 (Kamath), the disclosure of which is incorporated herein by reference, the continuous strip can make intermittent contact alternately with each of the electrodes, e.g. by spiral wrapping the fiber(s) around the electrodes which are separated by an optional electrically insulating spacer.

The resistive heating element may be composed of any suitable resistive material, e.g. a conductive ceramic such as $BaTi_2O_3$, a metal oxide such as magnesium oxide or aluminum oxide, or, as is preferred, a conductive polymer composition. A conductive polymer composition comprises a polymeric component and, dispersed or otherwise distributed therein, a particulate conductive filler. The polymeric component may be an organic polymer (such term being used to include siloxanes), an amorphous thermoplastic polymer (e.g. polycarbonate or polystyrene), an elastomer (e.g. polybutadiene or ethylene/propylene diene (EPDM) polymer), or a blend comprising at least one of these. Particularly preferred are crystalline organic polymers such as polymers of one or more olefins, particularly polyethylene; copolymers of at least one olefin and at least one monomer copolymerisable therewith such as ethylene/acrylic acid, ethylene/ethyl acrylate, and ethylene/vinyl acetate copolymers; melt-shapeable fluoropolymers such as polyvinylidene fluoride and ethylene tetrafluoroethylene; and blends of two or more such polymers. Such crystalline polymers are particularly preferred when it is desired that the composition exhibit PTC (positive temperature coefficient of resistance) behavior. The term "PTC behavior" is used in this specification to denote a composition or an electrical device which has an $R_{14}$ value of at least 2.5 and/or an $R_{100}$ value of at least 10, and particularly preferred that it should have an $R_{30}$ value of at least 6, where $R_{14}$ is the ratio of the resistivities at the end and the beginning of a 14° C. temperature range, $R_{100}$ is the ratio of the resistivities at the end and the beginning of a 100° C. range, and $R_{30}$ is the ratio of the resistivities at the end and the beginning of a 30° C. range. The composition also comprises a particulate conductive filler, e.g. carbon black, graphite, metal, metal oxide, or particulate conductive polymer, or a combination of these. Optionally, the conductive polymer composition comprises inert fillers, antioxidants, stabilizers, dispersing agents, crosslinking agents, or other components. Mixing is preferably achieved by melt-processing, e.g. melt-extrusion. The composition may be crosslinked by irradiation or chemical means. Self-regulating strip heaters in which the electrodes comprise elongate wires and the resistive heating elements comprise a conductive polymer composition are particularly useful. Suitable conductive polymers for use in this invention, and heaters whose insulating jackets can be modified in accordance with the present invention are disclosed in U.S. Pat. No. 3,858,144 (Bedard et al), U.S. Pat. No. 3,861,029 (Smith-Johannsen et al), U.S. Pat. No. 4,017,715 (Whitney et al), U.S. Pat. No. 4,188,276 (Lyons et al), U.S. Pat. No. 4,237,441 (van Konynenburg et al), U.S. Pat. No. 4,242,573 (Batliwalla), U.S. Pat. No. 4,246,468 (Horsma), U.S. Pat. No. 4,334,148 (Kampe), U.S. Pat. No. 4,334,351 (Sopory), U.S. Pat. No. 4,388,607 (Toy et al), U.S. Pat. No. 4,398,084 (Walty), U.S. Pat. No. 4,400,614 (Sopory), U.S. Pat. No. 4,425,497 (Leary), U.S. Pat. No. 4,426,339 (Kamath et al), U.S. Pat. No. 4,435,639 (Gurevich), U.S. Pat. No. 4,459,473 (Kamath), U.S. Pat. No. 4,470,898 (Penneck et al), U.S. Pat. No. 4,514,620 (Cheng et al), U.S. Pat. No. 4,534,889 (van Konynenburg et al), U.S. Pat. No. 4,547,659 (Leary), U.S. Pat. No. 4,560,498 (Horsma et al), U.S. Pat. No. 4,582,983 (Midgley et al), U.S. Pat. No. 4,574,188 (Midgley et al), U.S. Pat. No. 4,591,700 (Sopory), U.S. Pat. No. 4,658,121 (Horsma et al), U.S. Pat. No. 4,659,913 (Midgley et al), U.S. Pat. No. 4,661,687 (Afkhampour et al), U.S. Pat. No. 4,673,801 (Leary), and U.S. Pat. No. 4,764,664 (Kamath et al), U.S. Pat. No. 4,774,024 (Deep et al), U.S. Pat. No. 4,775,778 (van Konynenburg et al), and U.S. Pat. No. 4,980,541 (Shafe et al); European Patent publication Nos. 38,713, 38,718, 74,281, 197,759, and 231,068; and International Publication Nos. WO 90/11001 (Batliwalla et al) and WO 91/03822 Emmett). The disclosure of each of these patents, publications, and applications is incorporated herein by reference.

When the heating element is in the form of a continuous strip of conductive polymer having electrodes embedded therein, the cross-section of the strip may be of any suitable shape, e.g. rectangular, round, or dumb-bell. Many useful elongate heaters comprise a core which is composed of a conductive polymer composition exhibiting PTC behavior and which has a substantially constant cross-section along the length of the heater. We have found that the smaller the aspect ratio of the cross section the better the performance of the heater in the VW-1 flame test. The ratio of the maximum dimension of the cross-section of the heating element (often the axis of the electrodes) to the minimum dimension of the cross-section of the heating element (often the thickness of the heater) is often at most 7:1, preferably at most 3:1, particularly at most 2:1, e.g. about 1:1. The maximum dimension of the cross-section is often less than 1 inch (2.54 cm), e.g. less than 0.6 inch (1.5 cm) and/or the maximum area of the cross-section is less than 1.25 $inch^2$ (8.0 $cm^2$), e.g.. less than 0.5 $inch^2$ (3.2 $cm^2$).

The first insulating jacket surrounds (and preferably contracts) the core and comprises an organic polymer. Suitable polymers include those which are suitable for use in a conductive polymer composition, as well as other polymers such as polyurethanes. Especially because the polymer composition used in the first insulating jacket is often modified by the presence of flame retardants, e.g. $Al_2O_3.3H_2O$, or a mixture of $Sb_2O_3$ and a brominated flame retardant, or other fillers, polymers which are relatively flexible are preferred. If it is desirable to have a good physical bond between the core and the first insulating jacket, the compositions used for the core and the first insulating jacket may contain the same polymer. The first insulating jacket may be applied to the core using any convenient means, e.g. melt-forming, solvent-casting, or shaping of a preformed sheet of material over the core. It is generally preferred that the jacket be melt-extruded over the core by either a tube-down or a pressure extrusion process. If the heater is to be annealed, i.e. heat-treated above the crystalline melting point of the polymeric component in the core, the melting point of the organic polymer in the first insulating jacket should be higher than that of the core. Generally, the first insulating jacket has a thickness of less than 0.075 inch (0.19 cm), preferably less than 0.050 inch (0.125 cm), particularly less than 0.040 inch (0.1 cm), e.g. 0.015 to 0.030 inch (0.04 to 0.075 cm).

A second insulating jacket surrounds the first insulating jacket. It often contacts, and may be bonded to, the first insulating jacket. The second insulating jacket may comprise an organic polymer which may be the same as or different from that of the first insulating jacket, or it may comprise another material such as a glass, e.g. fiberglass, a ceramic, a woven or nonwoven fabric, a metal, e.g. aluminum foil, or an insulated metal, e.g. metallized polyester. For flexibility and low weight, it is preferred that the second insulating jacket be an insulating material which comprises an organic polymer. For some applications, it is preferred that at least 75% by weight of the organic polymer in the second insulating jacket is the same as at least 75% by weight of the organic polymer in the first insulating jacket.

In one preferred embodiment, the second insulating jacket has a thickness of less than 0.020 inch (0.04 cm), particularly less than 0.010 inch (0.025 cm), especially less than 0.006 inch (0.15 cm), most especially less than 0.005 inch (0.13 cm), e.g. 0.001 to 0.005 inch (0.002 cm to 0.013 cm). Especially suitable are films of such polymers as polyesters (e.g. polyethylene terephthalate sold under the trade name Mylar™ by DuPont), polyimide (e.g. films sold under the trade name Kapton™ by DuPont), polyvinylidene fluoride (e.g. films sold under the trade name Kynar™ by Pennwalt), polytetrafluoroethylene (e.g. films sold under the trade name Teflon™ by DuPont), or polyethylene. In addition, aluminum-coated polyester is useful, particularly for applications in which it is important that any moisture or plasticizer from an insulation layer be prevented from penetrating and damaging the core or the first insulating jacket. Such films, in the form of a sheet, i.e. preformed films or tapes, can be wrapped around the first insulating jacket, e.g. spirally with an overlapping seam which runs spirally down the heater, or as a so-called "cigarette wrap" so that there is an overlapping seam which runs straight down the heater. Under normal conditions, either spiral wrapping or cigarette wrapping is conducted without an adhesive being present, so that the insulating layer does not provide a total barrier to penetration by moisture. These heaters would thus not be suitable for use if it were necessary that it be immersed for a long period, e.g. as in a waterbed heater, during which time the fluid could enter through the seams of the wrapped insulation. Alternatively, the materials comprising the films can be formed over the first insulating jacket using any other suitable process, e.g. melt-extrusion such as by a tube-down process, or by solvent casting. In some instances the material comprising the second insulating jacket is one which has been oriented so that, under the conditions of the VW-1 test, the second jacket shrinks before it burns.

In one embodiment, the material of the second insulating jacket is identical to the material of the first insulating jacket.

In one embodiment, the total thickness of first and second jackets is less than 0.025 inch (0.06 cm).

A metallic braid may be provided over the second insulating jacket in some embodiments.

When the second insulating layer comprises a film such as a polyester film or a metallized (e.g. laminated aluminum) polyester film, it can be very useful in protecting the heater from resistance increases which result from the penetration of plasticizers from an external insulation layer, particularly polyvinyl chloride (PVC) foam. Such foam insulation is commonly used to insulate the heater when it wrapped around a pipe or other substrate.

The invention is illustrated by the drawings, in which FIG. 1 is a cross-sectional view of an elongate heater 1 of the invention. A resistive heating element comprising a conductive polymer composition 3 formed around two electrodes 5,7 is surrounded by a first insulating jacket 9. A second insulating jacket 11, e.g. a thin film of an insulating polymer such as polyethylene, polyester, or polyimide, a thin metal foil such as aluminum, or a metallized polymer film, is wrapped around the first insulating jacket in such a way that there is a region of overlap 13. An optional metallic grounding braid 15 covers the second insulating jacket.

Figure 2:
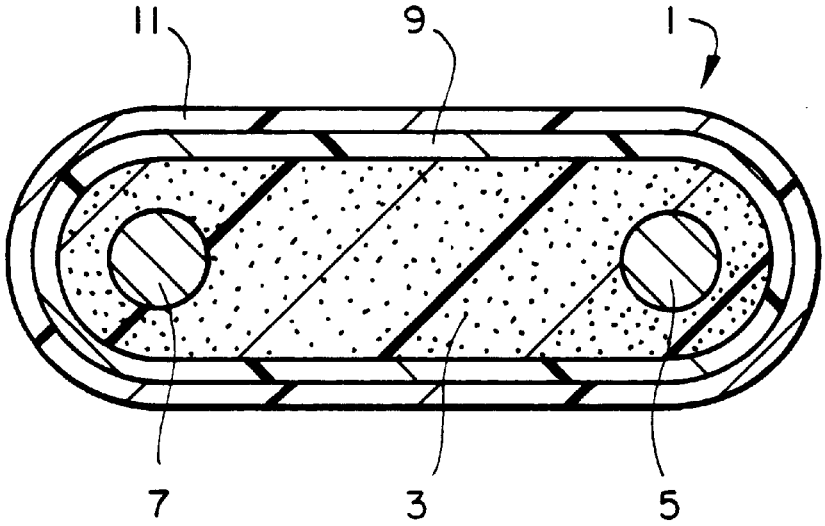

FIG. 2 is a cross-sectional view of a second elongate heater of the invention. In this embodiment, the resistive heating element comprising the conductive polymer composition 3 and the two elongate electrodes 5,7 is surrounded by a thin first insulating jacket 9 and a thin second insulating jacket 11.

The invention is illustrated by the following examples.

EXAMPLES 1 TO 23

For each example, a heater strip was prepared following the procedure described in Heater 1 below. For some examples, the heater strip was then wrapped with a second insulating jacket as specified. For those heaters listed as being braided, a metal braid comprising five strands of 28 AWG tin-coated copper wire was formed over the second insulating jacket or the sole insulating jacket to cover 86 to 92% of the surface. The braid had a thickness of about 0.030 inch (0.076 cm) and was equivalent to 18 AWG wire. Each heater was then tested using the Flame Test described below.

Heater 1

The ingredients listed under composition 1 in Table I were preblended and then mixed in a co-rotating twin-screw extruder to form pellets. The pelletized composition was extruded through a 1.5 inch (3.8 cm) extruder around two 22 AWG 7/30 stranded nickel/copper wires each having a diameter of 0.031 inch (0.079 cm) to produce a core with an electrode spacing of 0.106 inch (0.269 cm) from wire center to wire center and a thickness of 0.083 inch (0.211 cm) at a center point between the wires. A first insulating jacket with a thickness of 0.030 inch (0.076 cm) comprising a composition containing 10% by weight ethylene/vinyl acetate copolymer (EVA), 36.8% medium density polyethylene, 10.3% ethylene/propylene rubber, 23.4% decabromodiphenyloxide (DBDPO), 8.5% antimony oxide ($Sb_2O_3$), 9.4% talc, 1.0% magnesium oxide, and 0.7% antioxidant was then extruded over the core. The jacketed heater was irradiated to a dose of 15 Mrads.

Heater 2

Using the ingredients listed under composition 2 in Table I, a heater was prepared, extruded, jacketed, and irradiated using the procedure of Heater 1.

Heater 3

Using the ingredients listed under composition 3 in Table I, a heater was prepared, extruded, jacketed, and irradiated using the procedure of Heater 1.

Flame Test

Heaters were tested following the procedure of the Underwriters' Laboratory (UL) VW-1 vertical-wire flame test, as described in Reference Standard for Electrical Wires, Cables, and Flexible Cords, UL 1581, No. 1080, Aug. 15, 1983, the disclosure of which is incorporated herein by reference. In this test, a heater sample with a length of 19.68 inches (0.5 m) is held in a vertical position inside a metal enclosure which has dimensions of 12 inches (30.5 cm) wide, 14 inches (35.5 cm) deep, and 24 inches (61.0 cm) high with an open top and front. The enclosure is positioned in a draft-free exhaust hood. A horizontal layer of untreated surgical cotton with a thickness of 0.25 to 1.0 inch (0.6 to 2.5 cm) is laid on the floor of the hood underneath the heater. An indicator flag prepared from a strip of 0.5 inch (1.3 cm) wide unreinforced 60 pound kraft paper (94 g/m$^2$) is positioned near the top of the heater and projects 0.75 inch (1.9 cm) toward the back surface of the enclosure. A Tirrill gas burner with a blue cone of flame of 1.5 inches (3.8 cm) and a temperature at the flame tip of 816° C. is applied sequentially five times to a point on the front of the heater at a distance of 10 inches (25.4 cm) below the bottom edge of the paper flag. The period between sequential applications of the test flame is either (1) 15 seconds if the sample ceases flaming within 15 seconds, or (2) the duration of the sample flaming time if the flaming lasts longer than 15 seconds but less than 60 seconds.

In order to pass the test, the sample cannot "flame" longer than 60 seconds following any of five 15-second applications of the test flame. In addition, the cotton underneath the sample at the bottom of the enclosure cannot be ignited during the test and the paper flag at the top of the sample cannot be damaged or burned over more than 25% of its area.

For each heater, at least five samples were tested under the Flame Test conditions. For heaters in which one or more samples survived the five flame applications and passed the test, the test was continued until all the samples had failed. The percent of samples passing the test, and the number of applications of flame until failure occurred is recorded in Table II.

TABLE I

CONDUCTIVE POLYMER FORMULATIONS
(Components in Percent by Weight)

| Component | Composition 1 | 2 | 3 |
|---|---|---|---|
| EEA | 39.0 | 31.4 | 26.6 |
| MDPE | 38.0 | 34.0 | 25.8 |
| CB | 22.0 | 17.6 | 14.9 |
| Antioxidant | 1.0 | 1.0 | 0.7 |

TABLE I-continued

CONDUCTIVE POLYMER FORMULATIONS
(Components in Percent by Weight)

| Component | Composition 1 | 2 | 3 |
|---|---|---|---|
| $Sb_2O_3$ | | 4.3 | 8.6 |
| DBDPO | | 11.7 | 23.4 |

Notes to Table I:
EEA is ethylene/ethyl acrylate copolymer.
MDPE is medium density polyethylene.
CB is carbon black with a particle size of 28 nm.
Antioxidant is an oligomer of 4,4-thio bis(3-methyl 1-6-6-butyl phenol) with an average degree of polymerisation of 3 to 4, as described in U.S. Pat. No. 3,986,981.
$Sb_2O_3$ is antimony trioxide with a particle size of 1.0 to 1.8 $\mu$m.
DBDPO is decabromodiphenyl oxide (also known as decabromodiphenylether).

TABLE II

FLAME TESTING SUMMARY

| Example | Heater | Braid | Wrapping Material | Thickness (mils) | % Pass 5 Flames | Applications to Fail |
|---|---|---|---|---|---|---|
| 1 | 1 | No | None | — | 50 | 4–5 |
| 2 | 1 | Yes | None | — | 0 | 4–5 |
| 3 | 1 | Yes | PEs 1 | 1 | 100 | 7 |
| 4 | 2 | No | None | — | 60 | 4–5 |
| 5 | 2 | Yes | None | — | 0 | 4–5 |
| 6 | 2 | Yes | PEs 1 | 1 | 100 | 7–8 |
| 7 | 2 | No | PEs 1 | 1 | 100 | |
| 8 | 2 | Yes | PEs 2 | 1 | 100 | 6–7 |
| 9 | 2 | Yes | PEs 3 | 2 | 80 | 5–6 |
| 10 | 2 | Yes | Al/PEs | 1 | 100 | 6–7 |
| 11 | 2 | No | Al/PEs | 1 | 0 | 3 |
| 12 | 2 | Yes | Al | 1 | 100 | 7 |
| 13 | 2 | No | Al | 1 | 33 | 4–7 |
| 14 | 2 | Yes | TFE 2 | 2 | 100 | 6 |
| 15 | 2 | Yes | PI | 2 | 60 | 4–5 |
| 16 | 2 | Yes | Glass | 5 | 100 | 6–7 |
| 17 | 2 | Yes | PE 1 | 1.25 | 60 | 5–6 |
| 18 | 2 | Yes | PE 2 | 3 | 100 | 6 |
| 19 | 2 | Yes | $PVF_2$ | 2 | 20 | 5–6 |
| 20 | 3 | No | None | — | 100 | 6 |
| 21 | 3 | Yes | None | — | 0 | 4–5 |
| 22 | 3 | Yes | PEs 1 | 1 | 100 | 7–8 |
| 23 | 3 | Yes | Al/PEs | 1 | 100 | 7 |

Notes to Table II:
PEs 1 is clear 0.001 inch (0.0025 cm) thick polyester film available from Pelcher-Hamilton Corporation as Phanex ® IHC.
PEs 2 is white 0.001 inch (0.0025 cm) thick polyester film available from Pelcher-Hamilton Coroporation as Phanex ® YVC.
PEs 3 is a film laminate of 0.001 inch thick polyester and 0.001 inch (0.0025 cm) thick blue polyethylene, available from Nepco Corporation as product No. 1232.
Al/PEs is aluminized polyester film with a thickness of 0.001 inch (0.0025 cm).
Al is aluminum foil with a thickness of 0.001 inch (0.0025 cm).
TFE is a 0.002 inch thick multilaminar cast polytetrafluoroethylene film, available from Kemfab Corporation as DF1000.
PI is 0.002 inch (0.005 cm) thick polyimide film, available from DuPont as Kapton ™ HN200.
Glass is 0.005 inch thick fiberglass woven tape available from Crane as Craneglass 230.
PE 1 is low density polyethylene film with a thickness of 1.25 inch (0.003 cm) available from Gillis and Lane.
PE 2 is low density polyethylene film with a thickness of 0.003 inch (0.008 cm) available from Gillis and Lane.
$PVF_2$ is Kynar ™ polyvinylidene fluoride film with a thickness of 0.002 inch (0.005 cm) available from Pennwalt.

EXAMPLE 24 (COMPARATIVE EXAMPLE)

A conductive composition comprising 39% by weight ethylene/ethyl acrylate, 39% medium density polyethylene, 22% carbon black, and 1.0% antioxidant was prepared and was then extruded over two 22 AWG 7/30 stranded nickel/copper wires each having a diameter of 0.031 inch (0.079 cm) to produce a core with a generally round shape. The diameter of the core was approximately 0.145 inch (0.368 cm) and the electrode spacing was approximately 0.075 inch (0.191 cm) from wire center to wire center. A first insulating jacket with a thickness of 0.035 inch (0.089 cm) comprising thermoplastic rubber (TPR™ 8222B, available from Reichhold Chemicals) containing 30% by weight flame retardant (8% by weight $Sb_2O_3$ and 22% DBDPO) was then extruded over the core. The jacketed heater was irradiated to a dose of approximately 10 Mrads. When tested under VW-1 conditions, the heater failed.

EXAMPLE 25

A heater core was prepared following the procedure of Example 24. A first insulating jacket with a thickness of 0.020 inch (0.051 cm) comprising thermoplastic rubber (TPR™ 8222B, available from Reichhold Chemicals) was extruded over the core. A second insulating jacket with a thickness of 0.018 to 0.020 inch (0.046 to 0.051 cm) comprising the same material was then extruded over the first insulating jacket. The jacketed heater was irradiated to a dose of approximately 10 Mrads. This heater passed the VW-1 test.

EXAMPLE 26 (COMPARATIVE EXAMPLE)

A conductive composition comprising 29.3% by weight ethylene/ethyl acrylate, 32.4% high density polyethylene, 17.2% carbon black, 20.0% zinc oxide, 0.6% process aid, and 0.5% antioxidant was prepared and was then extruded over two 16 AWG 19-strand nickel/copper wires (each with a diameter of 0.057 inch (0.145 cm)) to produce a core with a wire spacing of 0.260 inch (0.660 cm) from wire center to wire center. The cross-section of the heater core between the wires was generally rectangular. A first insulating jacket with a thickness of 0.030 inch (0.076 cm) comprising the jacketing composition described in Example 1 was then extruded over the core. A tin-coated copper grounding braid was then positioned around the first insulating jacket. This heater passed the VW-1 test.

The response of the heater to thermal aging at 88° C. (190° F.) when in contact with different insulation layers was determined by cutting the heater to give samples 12 inches (30.5 cm) long with electrodes exposed at one end. The other end was covered with a heat-shrinkable end cap to prevent ingress of moisture or other fluids. The samples were each positioned on an aluminum plate with a thickness of 0.375 inch (0.95 cm), and then were covered with a sheet of insulation with a thickness of 0.38 to 0.75 inch (0.97 to 1.90 cm). A top aluminum plate with a thickness of 0.125 inch (0.32 cm) was positioned over the insulation layer. The resistance at 21° C. (70° F.) was measured to give the initial resistance and the samples were then placed in an air circulating oven heated to 88° C. Periodically, the samples were removed from the oven, cooled to 21° C., and their resistance was measured. A "normalized resistance", $R_N$, was then calculated by dividing the resistance value after aging by the initial value. The results of the testing are shown in Table III.

EXAMPLE 27

A heater was prepared according to Example 26 except that a second insulating layer composed of 0.001 inch (0.0025 cm) thick polyester film (available from Pelcher-Hamilton Corporation as Phanex® IHC) was inserted between the first insulating layer and the grounding braid by helically wrapping it around the first insulating layer. The results of testing are shown in Table III.

EXAMPLE 28

A heater was prepared according to Example 27 except that the second insulating layer was composed of an aluminized polyester film with a thickness of 0.001 inch (0.0025 cm). The results of testing are shown in Table III.

It is apparent that the heaters which were wrapped with either polyester or metallized polyester had superior performance when they were exposed to a PVC foam which contained plasticizers.

TABLE III $R_N$ AFTER 100 OR 1000 HOURS AT 88° C.

| | | Silicone Insulation | | Rubatex Insulation | | Armatex Insulation | |
|---|---|---|---|---|---|---|---|
| Example | Second Layer | $R_N$ @ 100 | $R_N$ @ 1000 | $R_N$ @ 100 | $R_N$ @ 1000 | $R_N$ @ 100 | $R_N$ @ 1000 |
| 25 | None | 1.0 | 1.25 | 5.0 | <5 | 1.1 | 2.2 |
| 27 | PEs 1 | 1.17 | 1.45 | 1.15 | 1.4 | | |
| 28 | Al/PEs | 1.20 | 1.59 | 1.30 | 1.53 | | |

Notes to Table III:
Silicone is a 0.38 inch (0.97 cm) thick sheet of silicone foam, available from Insulectro as Cohrlastic foam, softgrade.
Rubatex ™ is a polyvinyl chloride foam insulation with a thickness of 0.75 inch (1.91 cm), available from Rubatex. It contains plasticizers.
Armatex ™ is a polyvinyl chloride foam insulation with a thickness of 0.75 inch (1.91 cm), available from Armstrong. It contains plasticizers.

What is claimed is:

1. An elongate heater which passes the VW-1 flame test and which comprises (1) a core which comprises a resistive heater element which comprises a conductive polymer composition which exhibits PTC behavior;

(2) a first insulating jacket which
 (a) surrounds the core, and
 (b) is composed of a first insulating material comprising an organic polymer; and (3) a second insulating jacket which surrounds and contacts the first insulating jacket;

the components of the heater being such that (a) a heater which is substantially identical, except that it does not contain the second insulating jacket, fails the VW-1 flame test, and (b) a heater which is substantially identical, except that it does not contain the first insulating jacket, fails the VW-1 flame test.

2. A heater according to claim 1 wherein at least one of the following features is present:

(1) at least one of the first insulating jacket and the second insulating jacket is less than 0.015 inch (0.038 cm) thick;

(2) the second insulating jacket has been formed by wrapping a preformed tape around the first insulating jacket;

(3) the heater contains a metallic braid which surrounds the second insulating jacket;

(4) at least 75% by weight of the organic polymer in the first insulating material is a polymer which is not a polymer selected from one or more of a polyurethane, polyvinylidene fluoride, and polyethylene;

(5) the second insulating jacket is composed of a second insulating material which comprises an organic polymer, at least 75% by weight of the organic polymer being a polymer which is not a polymer selected from one or more of polyethylene, an ethylene/tetrafluoroethylene copolymer, and fluorinated ethylene propylene copolymer;

(6) the second insulating jacket is composed of a second insulating material which comprises an organic polymer, and at least 75% by weight of the organic polymer in the first insulating material is the same as at least 75% by weight of the organic polymer in the second insulating material;

(7) the second jacket has been formed by a tube-down extrusion process;

(8) the core of the heater comprises (a) a resistive heating element which has a substantially constant cross-section along the length of the heater, and (b) two elongate spaced-apart electrodes which are embedded in the resistive heating element, the ratio of the maximum dimension of the cross-section of the heating element to the minimum dimension of the cross-section of the heating element being at most 7:1, the maximum dimension of the cross-section preferably being less than 1 inch (2.54 cm), or the maximum area of the cross-section being less than 1.25 $inch^2$ (8.06 $cm^2$);

(9) the core of the heater comprises (a) two elongate spaced-apart electrodes, and (b) a resistive heating element which is in the form of a continuous strip which makes intermittent contact alternately with each of the electrodes;

(10) the core of the heater comprises (a) two elongate spaced-apart electrodes and (b) a plurality of spaced-apart resistive heating elements each of which makes contact with each of the electrodes;

(11) the second jacket is composed of a second insulating material comprising an organic polymer which has been oriented so that, under the conditions of the VW-1 test, the second jacket shrinks before it burns;

(12) the second jacket is not bonded to the first jacket;

(13) the sum of the thickness of the first jacket and the thickness of the second jacket is less than 0.040 inch (0.10 cm);

(14) if the core of the heater comprises (a) a resistive heating element which is composed of a conductive polymer composition exhibiting PTC behavior and (b) two elongate spaced-apart electrodes which are embedded in the resistive heating element, the heater has not been made by a process which comprises heating the heating element, after the first insulating jacket has been placed around the heating element, to a temperature above the crystalline melting point of any polymer in the heating element;

(15) the first insulating material is such that a heater which is substantially identical, except that the first and second insulating jackets are replaced by a single insulating jacket which is composed of the first insulating material and which has the same thickness as the sum of the thickness of the first and second jackets, fails the VW-1 test;

(16) the second insulating material is such that a heater which is substantially identical, except that the first and second insulating jackets are replaced by a single insulating jacket which is composed of the second insulating material and which has the same thickness as the sum of the thickness of the first and second jackets, fails the VW-1 test;

(17) the heater contains a metallic braid which surrounds the second insulating jacket; and

(18) at least one of the resistive heating element, the first insulating jacket, and the second insulating jacket is free from bromine-containing ingredients.

3. A heater according to claim 1 wherein the conductive polymer is in the form of a continuous strip, and (b) the resistive heating element comprises two elongate electrodes which are embedded in the conductive polymer.

4. A heater according to claim 3 wherein the second insulating jacket contacts the first insulating jacket and is composed of a second insulating material which comprises an organic polymer.

5. A heater according to claim 3 wherein the second insulating material is the same as the first insulating material.

6. A heater according to claim 1 wherein the second insulating jacket contacts the first insulating jacket and is composed of a second insulating material which comprises an organic polymer.

7. A heater according to claim 6 wherein the the second insulating material is the same as the first insulating material.

8. An elongate heater which comprises (1) a core which comprises a resistive heating element which comprises a conductive polymer composition which exhibits PTC behavior;

(2) a first insulating jacket which surrounds the core, and which is composed of a first insulating material comprising an organic polymer; and (3) a second insulating jacket which has been formed by wrapping a preformed tape of a second insulating material around the first insulating jacket so that the edges of the tape overlap.

9. A heater according to claim 8 wherein the tape is less than 0.005 inch (0.013 cm).

10. A heater according to claim 9 wherein the tape comprises a polyester.

11. A heater according to claim 9 wherein the tape is less than 0.002 inch (0.005 cm) thick.

12. A heater according to claim 10 which further comprises:

(4) a metallic braid which surrounds and contacts the second insulating jacket.

13. A heater according to claim 10 wherein the tape consists essentially of polyethylene terephthalate.

14. A heater according to claim 8 wherein the heater is not suitable for use as a water bed heater because the edges of the tape overlap without sealing.

15. A heater assembly for heating a substrate, said assembly comprising (1) a heater which comprises (a) a core which comprises a resistive heating element which comprises a continuous strip of a conductive polymer which exhibits PTC behavior;

(b) a first insulating jacket which surrounds the core, and which is composed of a first insulating material comprising an organic polymer; and (c) a second insulating jacket which has been formed by wrapping a preformed tape of a second insulating material or a metallized polymer tape around the first insulating jacket so that the edges of the tape overlap; and (2) an insulation layer which comprises PVC, said heater being positioned in contact with the substrate and being surrounded by the insulation layer.

16. An assembly according to claim 15 wherein the insulating layer comprises PVC foam.

17. An assembly according to claim 15 wherein two elongate electrodes are embedded in the continuous strip of conductive polymer.

18. An assembly according to claim 15 wherein the preformed tape of a second insulating material or the metallized polymer tape comprises a polyester.

19. An assembly according to claim 18 wherein the polyester consists essentially of polyester terephthalate.

* * * * *